US010571086B2

(12) United States Patent
Hiramatsu et al.

(10) Patent No.: US 10,571,086 B2
(45) Date of Patent: Feb. 25, 2020

(54) LIGHT FIXTURE

(71) Applicant: PANASONIC INTELLECTUAL PROPERTY MANAGEMENT CO., LTD., Osaka (JP)

(72) Inventors: Kohji Hiramatsu, Osaka (JP); Tatsumi Setomoto, Osaka (JP); Hajime Ozaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/254,045

(22) Filed: Jan. 22, 2019

(65) Prior Publication Data

US 2019/0257486 A1 Aug. 22, 2019

(30) Foreign Application Priority Data

Feb. 22, 2018 (JP) ..... 2018-030132

(51) Int. Cl.

| | |
|---|---|
| ***F21V 21/00*** | (2006.01) |
| ***F21S 8/08*** | (2006.01) |
| ***H01Q 1/42*** | (2006.01) |
| *F21Y 115/10* | (2016.01) |

(52) U.S. Cl.

CPC ..... *F21S 8/081* (2013.01); *H01Q 1/42* (2013.01); *F21Y 2115/10* (2016.08)

(58) Field of Classification Search

CPC ... F21S 8/081; F21Y 2115/10; F21Y 2103/10; F21V 23/045

USPC ..... 362/249.02

See application file for complete search history.

(56) References Cited

U.S. PATENT DOCUMENTS

| | | | | |
|---|---|---|---|---|
| 9,408,268 | B2 * | 8/2016 | Recker | H02J 50/40 |
| 10,405,406 | B2 * | 9/2019 | Liszt | F21K 9/235 |
| 2014/0268790 | A1 * | 9/2014 | Chobot | F21V 23/0464 362/276 |
| 2015/0102729 | A1 * | 4/2015 | Creasman | G01J 1/0271 315/152 |
| 2015/0351187 | A1 * | 12/2015 | McBryde | H05B 33/0803 315/185 R |

FOREIGN PATENT DOCUMENTS

| | | |
|---|---|---|
| JP | 2014-167878 | 9/2014 |

* cited by examiner

*Primary Examiner* — Ali Alavi

(74) *Attorney, Agent, or Firm* — Greenblum & Bernstein, P.L.C.

(57) ABSTRACT

A light fixture includes: a board including a first insertion portion; a plurality of light-emitting elements mounted on a mounting surface of the board; a metal case on which the board is positioned; and an antenna that is housed in the metal case and wirelessly communicates with an external device. The metal case includes a second insertion portion at a position overlapping with the first insertion portion in a plan view of the metal case and the board. The antenna extends through the first insertion portion and the second insertion portion.

13 Claims, 6 Drawing Sheets

LIGHT FIXTURE

CROSS REFERENCE TO RELATED APPLICATION

This application claims the benefit of priority of Japanese Patent Application Number 2018-030132 filed on Feb. 22, 2018, the entire content of which is hereby incorporated by reference.

BACKGROUND

1. Technical Field

The present disclosure relates to light fixtures.

2. Description of the Related Art

Light fixtures are conventionally known which include a light source that emits light, a base having an attachment surface to which the light source is attached, and a pattern antenna that performs wireless communication (for example, see Patent Literature (PTL) 1 (Japanese Unexamined Patent Application Publication No. 2014-167878)).

SUMMARY

There has been a demand for ensuring antenna communication performance by disposing a pattern antenna in a cover below a base in a light fixture.

The present disclosure has an object to provide a light fixture that can ensure the antenna communication performance.

A light fixture according to one aspect of the present disclosure includes: a board including a first insertion portion; a plurality of light-emitting elements mounted on a mounting surface of the board; a metal case on which the board is positioned; and an antenna that is housed in the metal case and wirelessly communicates with an external device. The metal case includes a second insertion portion at a position overlapping with the first insertion portion in a plan view of the metal case and the board. The antenna extends through the first insertion portion and the second insertion portion.

According to the present disclosure, it is possible to ensure antenna communication performance.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, embodiments of the present disclosure will be described with reference to the drawings. It should be noted that the embodiments described below each show a generic or specific example. The numerical values, shapes, materials, structure components, the arrangement and connection of the structural components, etc. shown in the following embodiments are mere examples, and are not intended to limit the scope of the present disclosure. Furthermore, among the structural components in the following embodiments, structural components not recited in any one of the independent claims which indicate the broadest concepts are described as optional structural components.

It should be noted that the figures are schematic diagrams and are not necessarily precise illustrations. Moreover, in the figures, substantially identical structural components are assigned identical reference signs, and overlapping description is omitted or simplified.

It should also be noted that the expression "approximately XX" is intended to include something that can be recognized as substantially XX, and, for example, "approximately vertical" is intended to include not only exactly vertical but also something that can be substantially recognized as vertical.

Hereinafter, embodiments of a light fixture according to the present disclosure will be described.

Embodiment 1

[Configuration]

The following describes a configuration of light fixture 1 according to Embodiment 1 of the present disclosure.

Figure 1:
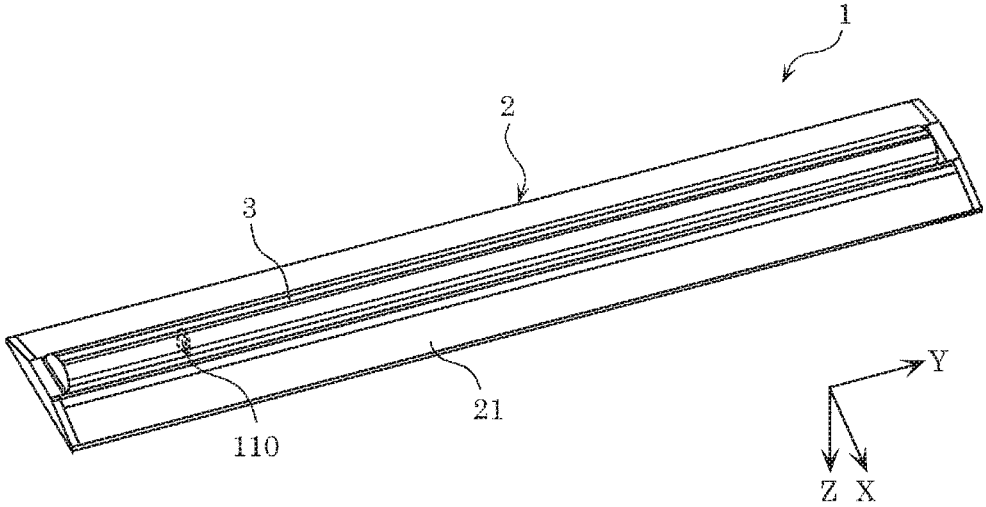
FIG. 1 is a perspective view of a light fixture according to Embodiment 1.
Figure 2:
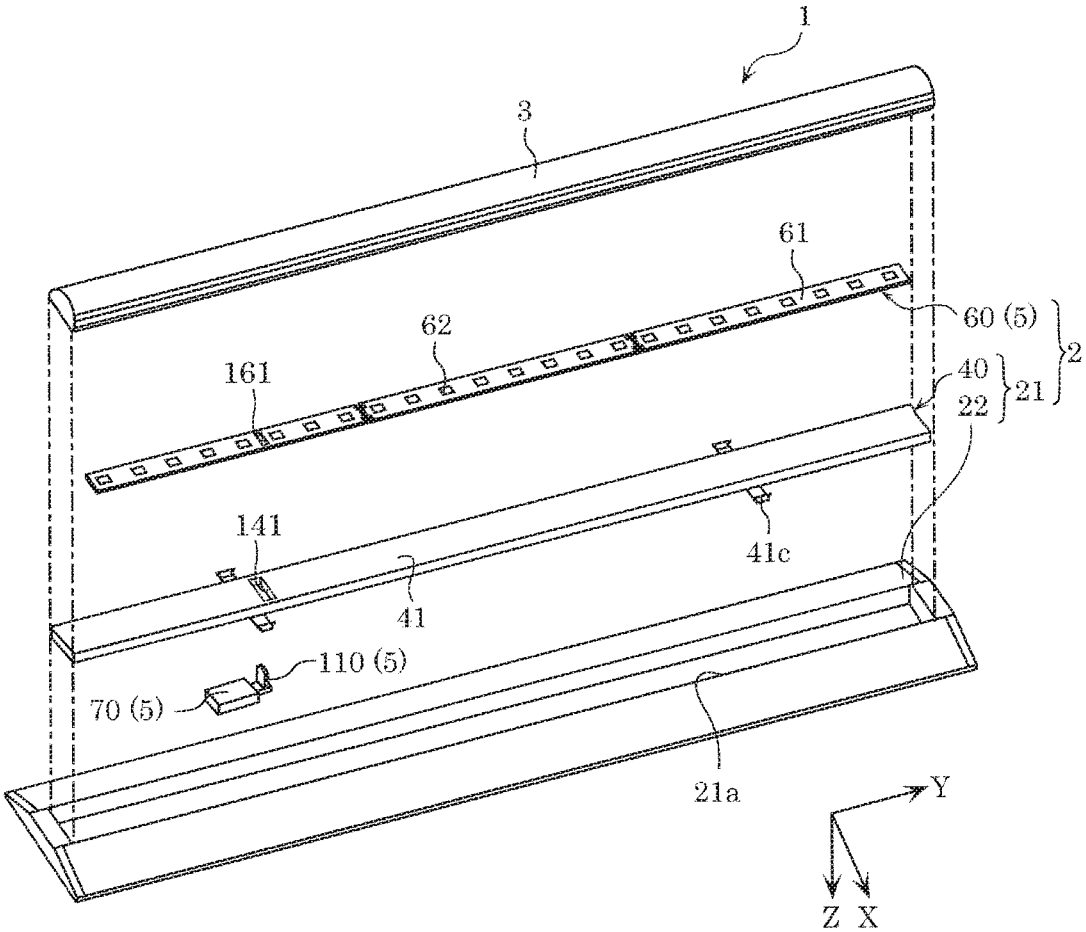
FIG. 2 is an exploded perspective view of the light fixture according to Embodiment 1.

FIG. 1 is a perspective view of light fixture 1 according to Embodiment 1. FIG. 2 is an exploded perspective view of light fixture 1 according to Embodiment 1.

A longitudinal direction of light fixture 1 is defined as a Y-axis direction, an array direction of first insertion hole 161 and second insertion hole 141 is defined as a Z-axis direction, and a direction orthogonal to the Y-axis direction and the Z-axis direction is defined as an X-axis direction. The directions shown in FIG. 1 correspond to the directions shown in FIG. 2. The same applies to the figures subsequent to FIG. 2.

Besides, the terms above, below, top surface, and so on are used to indicate locations of components, and do not limit an orientation when light fixture 1 is used.

As shown in FIG. 1 and FIG. 2, light fixture 1 is a light-emitting diode (LED) lamp having an elongated shape, and is fixed to, for example, a hook ceiling.

Light fixture 1 includes fixture body 2 and cover 3. Fixture body 2 is a component serving as the base of light fixture 1. Fixture body 2 includes metal case 21 (hereinafter also referred to as case 21) and lighting device 5.

Case 21 includes body 22 and base 40.

Body 22 has an elongated shape and has an approximately trapezoidal shape that widens from the center outward when a cross section of body 22 taken along a plane defined by the Z-axis direction and the X-axis direction is seen. Body 22 includes housing 21*a* recessed in the Z-axis direction. Housing portion 21*a* is a recess extending in the Y-axis direction. Housing portion 21*a* houses, for example, base 40, light-emitting module 60, power supply 70, and wireless module 110 to be described later. In other words, body 22 includes light-emitting module 60. Power supply 70, wireless module 110, base 40, light-emitting module 60, and cover 3 are arranged alongside to a downward direction in listed order from the bottom surface of housing portion 21*a*. Light-emitting module 60 and base 40 constitute a light bar. Body 22 is made of a metal material, such as aluminum and iron.

Base 40 is a frame that is elongated in the Y-axis direction and is made of ceramic, resin into which filler metal is mixed, or metal, such as aluminum and iron. In the present embodiment, base 40 is made of a metal material, such as iron, to dissipate heat of light-emitting module 60. In this case, for example, base 40 is thrilled into a predetermined shape by rolling or pressing steel plate cold commercial (SPCC) sheet metal. It should be noted that base 40 is not necessarily limited to a base made of only metal, and may be made of a material other than metal.

Figure 3:
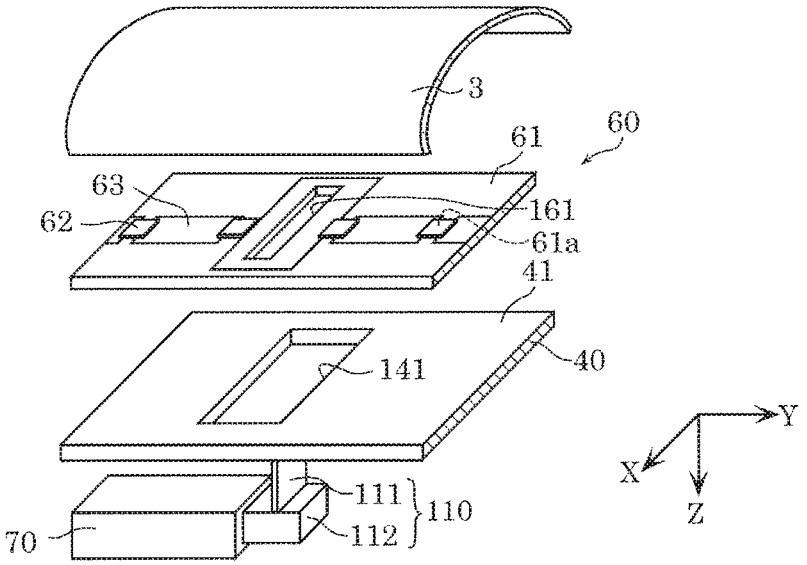
FIG. 3 is a partially enlarged perspective view of a cover, a light-emitting module, a wireless module, etc. of the light fixture according to Embodiment 1.
Figure 4:
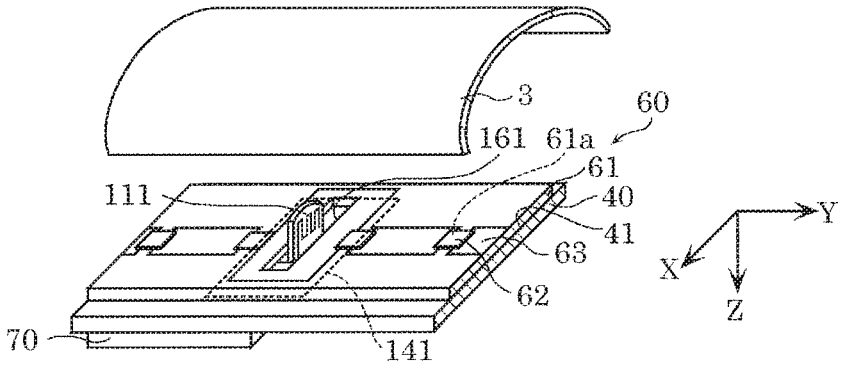
FIG. 4 is a partially enlarged perspective view of the cover, the light-emitting module, the wireless module, etc. of the light fixture according to Embodiment 1.
Figure 5:
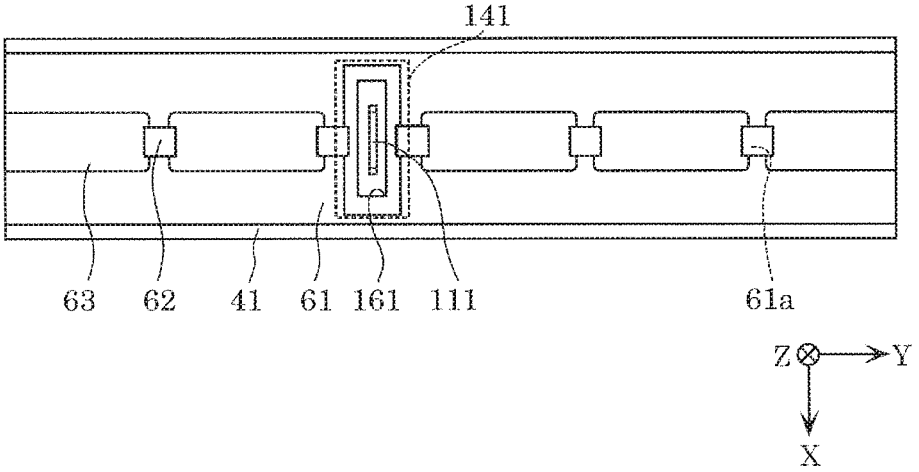
FIG. 5 is a plan view of the light-emitting module and an antenna of the light fixture according to Embodiment 1.

FIG. 3 is a partially enlarged perspective view of cover 3, light-emitting module 60, wireless module 110, etc. of light fixture 1 according to Embodiment 1. FIG. 4 is a partially enlarged perspective view of cover 3, light-emitting module 60, wireless module 110, etc. of light fixture 1 according to Embodiment 1. FIG. 5 is a plan view of light-emitting module 60 and antenna 111 of light fixture 1 according to Embodiment 1.

As shown in FIG. 3 to FIG. 5, base 40 has placement surface 41 and second insertion hole 141.

Placement surface 41 is a surface on the negative side of the Z-axis direction on which light-emitting module 60 is placed, and is elongated in the Y-axis direction. Circuit board 61 of light-emitting module 60 is placed on placement surface 41 of base 40. Placement surface 41 faces a surface opposite to mounting surface 61*a* of circuit board 61. Circuit board 61 is supported by base 40.

Second insertion hole 141 is a hole through which antenna 111 is inserted. The area of second insertion hole 141 is larger than a sectional area of antenna 111 when antenna 111 is cut along an X-Y plane so that antenna 111 does not touch second insertion hole 141. Moreover, in a plan view of base 40 and circuit board 61, the area of second insertion hole 141 is larger than the area of first insertion hole 161 of circuit board 61 to be described later. The shape of second insertion hole 141 may be a circle, a polygon, etc. in a plan view, and is not particularly limited. FIG. 3 shows an example in which the shape of first insertion hole 161 and second insertion hole 141 is a rectangle in a plan view. The area of second insertion hole 141 is the area (opening area) of a hole in a plan view of base 40. Second insertion hole 141 is one example of a second insertion portion.

Base 40 is removably attached to case 21. Base 40 has engaging portions 41*c* that protrude in the X-axis direction. Base 40 and case 21 are fixed by engaging portions 41*c* engaging one-on-one with engaged portions provided in housing portion 21*a* of case 21. It should be noted that base 40 and case 21 may be fixed with fixing components, such as screws. A gap is formed between base 40 and case 21 so that the gap can house wireless module 110 and power supply 70.

A connector is provided to an end of an electrical wire extending case 21 of fixture body 2, and a connector is provided to an end of an electrical wire extending in lighting device 5. Electric power necessary for lighting device 5 to emit light is supplied from case 21 to lighting device 5 by fitting the connector of case 21 and the connector of lighting device 5.

Lighting device 5 includes wireless module 110, light-emitting module 60, and power supply 70.

Wireless module 110 is a device that is housed in case 21 and wirelessly communicates with external devices. Wireless module 110 is placed on the negative side of the Y-axis direction relative to the center of base 40. Wireless module 110 is placed in housing portion 21*a* between base 40 and case 21. Wireless module 110 is directly and electrically connected to power supply 70 including a connector. It should be noted that wireless module 110 may be connected to power supply 70 via, for example, a control wire.

Wireless module 110 receives a control signal from an external device, such as a remote control, and transmits a request for a program to control light-emitting module 60. It should be noted that wireless module 110 may be, for example, a communication module for communicating with a program distribution server via the Internet. Besides, in practice, a communication device, such as a modem, a router, and a relay server, may be present between wireless module 110 and the program distribution server.

Wireless module 110 may use a communication system, such as Zigbee (registered trademark), Bluetooth (registered trademark), or WiFi (registered trademark).

Wireless module 110 includes antenna 111 and wireless controller 112.

Antenna 111 can transmit carrier waves and receive carrier waves of external devices. Antenna 111 is placed to be exposed from base 40 and circuit board 61. Specifically, antenna 111 is inserted through second insertion hole 141 of base 40 and first insertion hole 161 of circuit board 61 in listed order. More specifically, antenna 111 is inserted through second insertion hole 141 from a surface opposite to placement surface 41 toward placement surface 41, and is inserted through first insertion hole 161 from the surface opposite to mounting surface 61*a* toward mounting surface 61*a*. Antenna 111 protrudes beyond a surface of circuit board 61 on the negative side of the Z-axis direction (mounting surface 61*a*).

Antenna 111 has a portion rising approximately vertically relative to placement surface 41 of base 40 and mounting surface 61*a* on which light-emitting elements 62 are mounted. Moreover, antenna 111 has a flat plate shape and is disposed to be approximately parallel to an X-Z plane. In the present embodiment, because antenna 111 rises approximately vertically relative to placement surface 41 of base 40, that is, the X-Y plane, antenna 111 serves as, for example, a pattern antenna that can transmit and receive vertically polarized waves. Antenna 111 also rises approximately vertically relative to mounting surface 61*a* of circuit board 61. It should be noted that in the present embodiment, antenna 111 may be disposed to be approximately parallel to a Y-Z plane. In addition, antenna 111 may be capable of transmitting and receiving horizontally polarized waves.

Wireless controller 112 transmits, to power supply 70, an instruction based on a control signal received by antenna 111. Besides, wireless controller 112 can transmit information about light-emitting module 60 to an external device via antenna 111. Examples of the information about light-emitting module 60 include dimming, toning, and power consumption. Examples of the external device include a mobile terminal, such as a remote control, a smartphone, and a tablet terminal, a server, a general-purpose computer, and a wall switch.

Light-emitting module 60 is electrically connected to a controller via a connector. Light-emitting module 60 has an elongated plate shape, and includes light-emitting elements 62 and circuit board 61 on which light-emitting elements 62 are mounted. Light-emitting module 60 can control dimming and toning. In the present embodiment, eight light-emitting elements 62 are arranged in a row on each of three circuit boards 61.

Circuit boards 61 line up in the Y-axis direction. Middle circuit board 61 has one end electrically connected to one end of one of remaining circuit boards 61, and the other end electrically connected to one end of the other of remaining circuit boards 61.

Light-emitting elements 62 are mounted on mounting surface 61*a* of circuit board 61 to form a line on circuit board 61. Light-emitting elements 62 are electrically connected by metal wire 63. Light-emitting elements 62 are so-called surface mount device (SMD) LED elements. The SMD LED elements each are, specifically, a packaged LED element in which an LED chip is mounted in a resin-molded cavity and a phosphor-containing resin is enclosed in the cavity. Light-emitting elements 62 are turned on and off by power supply 70 included in lighting device 5. In addition, each of light-emitting elements 62 is dimmed and toned by power supply 70 controlling a power supply device.

Circuit board 61 is a mounting board for mounting light-emitting elements 62, and is, for example, a ceramic board, a resin board, or a metal base board that is insulation coated. In addition, circuit board 61 is a plate-shaped board having a rectangular plane in a plan view. It should be noted that circuit board 61 includes a pair of electrode terminals (an anode terminal and a cathode terminal) for receiving from the outside direct-current power for causing light-emitting elements 62 to emit light. Circuit board 61 is one example of a board.

Circuit board 61 has first insertion hole 161.

First insertion hole 161 is a hole through which antenna 111 can be inserted. When circuit board 61 is placed on base 40, first insertion hole 161 is in a position corresponding to second insertion hole 141. In other words, in a plan view of light-emitting module 60 and base 40, first insertion hole 161 overlaps with second insertion hole 141. As a result, antenna 111 can be inserted through first insertion hole 161 and second insertion hole 141. The shape of first insertion hole 141 may be a circle, a polygon, etc. in a plan view, and is not particularly limited. First insertion hole 161 is one example of a first insertion portion.

First insertion hole 161 extends crosswise to a direction of elongation of circuit board 61, at a position approximately midway between two adjacent light-emitting elements 62. Here, the crosswise direction is the X-axis direction.

The area of first insertion hole 161 is larger than a sectional area of antenna 111 when antenna 111 is cut along the X-Y plane so that antenna 111 does not touch first insertion hole 161. In addition, the area of first insertion hole 161 is smaller than the area of second insertion hole 141.

Power supply 70 includes a power supply circuit that supplies electrical power for causing light-emitting elements 62 to emit light, a dimming circuit that controls dimming of light-emitting module 60, and a toning circuit that controls toning of light-emitting module 60. The power supply circuit, dimming circuit, and toning circuit of power supply 70 are configured of circuit boards, such as printed-circuit boards, and electronic components mounted on the circuit boards. Power supply 70 converts alternating-current power from an external power source (AC), such as a commercial power source, into direct-current power of a predetermined level by performing rectification, smoothing, step-down, etc.

Moreover, power supply 70 controls electrical power to be supplied to light-emitting module 60, according to a control signal received by antenna 111. Power supply 70 controls operation of light-emitting module 60, such as turning on and off, dimming, and toning. Power supply 70 converts a control signal received by antenna 111, such as an on/off signal, a dimming signal, or a toning signal, into an electrical signal, and transmits the electrical signal to each of the power supply circuit, dimming circuit, toning circuit, and the like of power supply 70. The power supply circuit, the dimming circuit, and the toning circuit perform lighting control, dimming control, and toning control according to the control signals respectively received, and appropriate electrical power is supplied to light-emitting module 60. Power supply 70 controls light emission of light fixture 1 so that a change in light amount, color temperature, or spectral distribution of light emitted from light fixture 1 is kept within a predetermined range. The toning control includes, for example, adjustment of emission color or color temperature. It should be noted that a control device that controls the operation of light-emitting module 60, such as turning on and off, dimming, and toning, may be included in wireless controller 112.

Power supply 70 is electrically connected to wireless controller 112, and is housed in housing portion 21*a* of case 21. Power supply 70 and circuit board 61 are separated by base 40. Power supply 70 is electrically connected to, for example, light-emitting elements 62 via a connector. The connector is a circuit board connector for feeding electrical power to light-emitting module 60.

Cover 3 covers light-emitting module 60 and is light transmissive for light emitted from light-emitting elements 62 of light-emitting module 60. Cover 3 is made of, for example, a light-transmissive resin material, such as acryl and polycarbonate, or a light-transmissive material, such as transparent glass. In addition, cover 3 has a function of diffusing light emitted from light-emitting module 60.

For example, a milky white light-diffusing film is formed on cover 3 by applying, on the inner or outer surface of cover 3, a resin or a white pigment that contains a light-diffusing material (particles), such as silica or calcium carbonate. Moreover, cover 3 itself may be made of, for example, a resin material in which a light-diffusing material is dispersed.

It should be noted that cover 3 that diffuses light may be configured by forming a milky white light-diffusing film containing a light-diffusing material etc. on the inner or outer surface of a transparent cover, instead of dispersing a light-diffusing material inside cover 3. Moreover, cover 3, which diffuses light, may be configured to be diffusive by applying light diffusion treatment, instead of using a light-diffusing material. For example, cover 3 may be configured to be light diffusive by applying surface finishing, such as emboss process, to form fine unevenness on the inner or outer surface of the transparent cover, or printing a dot pattern on the inner or outer surface of the transparent cover. It should be rioted that even when diffusion treatment is applied, cover 3 may further include a light-diffusing material to increase the light diffusivity.

It should be noted that cover 3 need not have the function of diffusing light, and cover 3 may he transparent to the extent that the inside of cover 3 is visible from the outside of cover 3.

In light fixture 1 thus configured, when a user operates an external device, such as a remote control, antenna 111 receives a control signal from the external device and transmits the control signal to wireless controller 112. Wireless controller 112 converts the control signal, such as an on/off signal, a dimming signals, or a toning signal, into an electrical signal, and transmits the electrical signal to each of the power supply circuit, dimming circuit, toning circuit, or the like of power supply 70. Power supply 70 controls light-emitting module 60 according to the control signal, such as the on/off signal, the dimming signal, the toning signal, or the like.

Moreover, light fixture 1 corresponds to dimming and toning functions of light-emitting module 60. The dimming function is achieved by the controller increasing and decreasing a current output to light-emitting module 60. The toning function is achieved by the controller changing a balance of supply current to each of light-emitting elements 62 included in light-emitting module 60. It should be noted that the controller performs, for example, pulse-width modulation (PWM) control to increase and decrease the supply current to light-emitting module 60.

[Advantageous Effects]

Next, the following describes advantageous effects of light fixture 1 in the present embodiment.

As described above, light fixture 1 according to the present embodiment includes: circuit board 61 including first insertion hole 161; light-emitting elements 62 mounted on mounting surface 61*a* of circuit board 61; metal case 21 on which circuit board 61 is mounted; and antenna 111 that is housed in metal case 21 and wirelessly communicates with an external device. Metal case 21 includes second insertion hole 141 at a position overlapping with first insertion hole 161 in a plan view of metal case 21 and circuit board 61. Antenna 111 extends through first insertion hole 161 and second insertion hole 141.

In such light fixture 1, circuit board 61 includes first insertion hole 161, and case 21 includes second insertion hole 141. First insertion hole 161 at a position overlapping with second insertion hole 141 in a plan view of metal case 21 and circuit board 61. Antenna 111 extends through first insertion hole 161 and second insertion hole 141. In other words, antenna 111 is exposed from metal case 21 so that antenna 111 can wirelessly communicate with an external device. For this reason, light fixture 1 can communicate with the external device.

Accordingly, light fixture 1 makes it possible to ensure antenna communication performance.

Moreover, in light fixture 1 according to the present embodiment, antenna 111 has a portion extending approximately vertically relative to mounting surface 61*a*.

With this configuration, it is possible to ensure a radiation characteristic of antenna 111.

Moreover, in light fixture 1 according to the present embodiment, circuit board 61 is elongated. First insertion hole 161 extends crosswise to a direction of elongation of circuit board 61, at a position approximately midway between two adjacent light-emitting elements 62.

With this configuration, first insertion hole 161 extends crosswise to the direction of elongation of circuit board 61, at the position approximately midway between two adjacent light-emitting elements 62. For this reason, since light-emitting elements 62 emit an approximately equal amount of light onto antenna 111, it is possible to reduce a shadow made by antenna 111.

Moreover, in light fixture 1 according to the present embodiment, second insertion hole 141 overlaps with first insertion hole 161 in a plan view of first insertion hole 161 and second insertion hole 141. In addition, the area of first insertion hole 161 is smaller than the area of second insertion hole 141 in the plan view of first insertion hole 161 and second insertion hole 141.

With this configuration, since first insertion hole 161 reduces contact between second insertion hole 141 and antenna 111 when antenna 111 extends through first insertion hole 161 and second insertion hole 141, antenna 111 does not easily touch case 21 made of metal. Accordingly, it is possible to ensure the antenna communication performance of antenna 111.

Moreover, light fixture 1 according to the present embodiment further includes: wireless module 110 including antenna 111; and power supply 70 connected to wireless module 110.

With this configuration, it is not easy to impact the antenna communication performance of antenna 111 compared to a case in which power supply 70 and wireless module 110 are connected via a cable while being apart from each other.

Moreover, light fixture 1 according to the present embodiment further includes cover 3 that is light transmissive and covers light-emitting elements 62 and circuit board 61. Antenna 111 has a portion protruding from mounting surface 61*a* toward cover 3.

Moreover, in light fixture 1 according to the present embodiment, cover 3 has a light-diffusing property.

Moreover, light fixture 1 according to the present embodiment includes: circuit board 61 including first insertion hole 161; light-emitting elements 62 mounted on mounting surface 61*a* of circuit board 61; metal case 21 that houses circuit board 61; and antenna 111 that is housed in metal case 21 and wirelessly communicates with an external device. Metal case 21 includes second insertion hole 141 at a position overlapping with first insertion hole 161 in a plan view of metal case 21 and circuit board 61. Antenna 111 extends through first insertion hole 161 and second insertion hole 141, and is exposed from metal case 21 and circuit board 61.

Variation of Embodiment 1

Hereinafter, light fixture 1 according to the present variation will be described.

Figure 6:
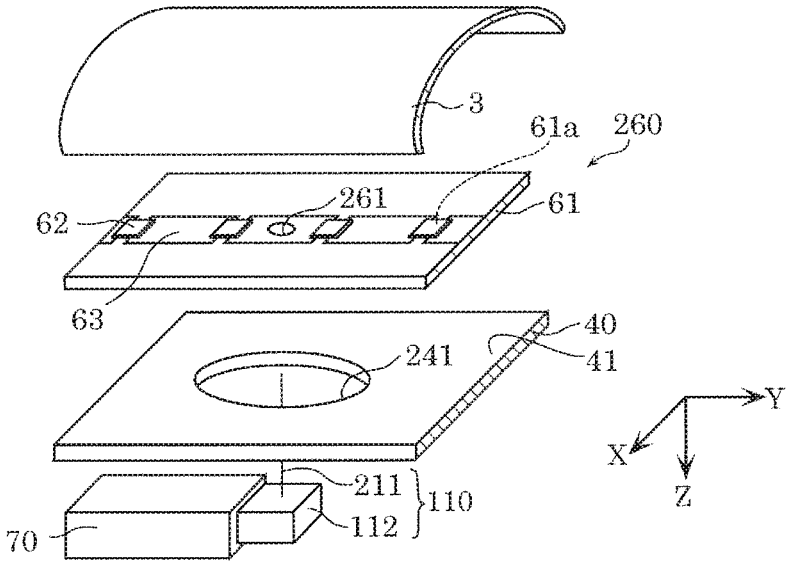
FIG. 6 is a partially enlarged perspective view of a cover, a light-emitting module, a wireless module, etc. of a light fixture according to a variation of Embodiment 1.

FIG. 6 is a partially enlarged perspective view of cover 3, light-emitting module 260, wireless module 110, etc. of light fixture 1 according to the variation of Embodiment 1. FIG.

Figure 8:
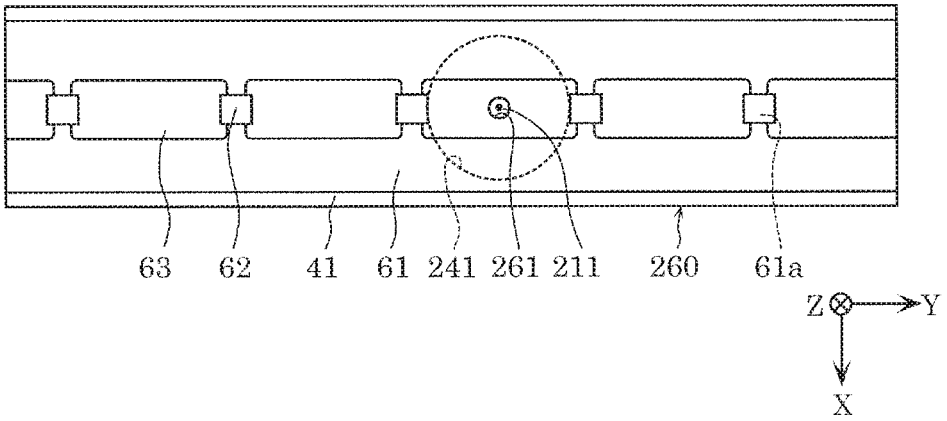
FIG. 8 is a plan view of the light-emitting module and an antenna of the light fixture according to the variation of Embodiment 1.

7 is a partially enlarged perspective view of cover 3, light-emitting module 260, wireless module 110, etc. of light fixture 1 according to the variation of Embodiment 1. FIG. 8 is a plan view of light-emitting module 260 and antenna 211 of light fixture 1 according to the variation of Embodiment 1.

Unless otherwise stated, light fixture 1 according to the present variation has the same configuration as Embodiment 1. Accordingly, the same structural components are assigned the same reference signs, and detailed description thereof is omitted.

Figure 7:
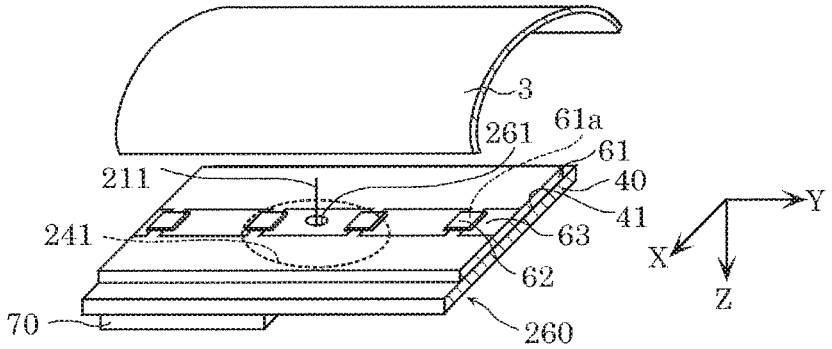
FIG. 7 is a partially enlarged perspective view of the cover, the light-emitting module, the wireless module, etc. of the light fixture according to the variation of Embodiment 1.

As shown in FIG. 6 to FIG. 8, antenna 211 is a monopole antenna, and extends through first insertion hole 261 and second insertion hole 241 in listed order to project out from mounting surface 61*a* of circuit board 61. Antenna 211 rises approximately vertically relative to placement surface 41, that is, the X-Y plane. For example, antenna 211 is a metal wire, such as a copper wire.

First insertion hole 261 and second insertion hole 241 in the present variation have a circular shape in a plan view. In a plan view of light-emitting module 260, first insertion hole 261 overlaps with second insertion hole 241. The center line of first insertion hole 261 is approximately the same as the center line of second insertion hole 241. First insertion hole 261 has a smaller minor diameter than second insertion hole 241 so that first insertion hole 261 supports antenna 211 inserted through first insertion hole 261. In other words, first insertion hole 261 may have a size to the extent that antenna 211 can be inserted through first insertion hole 261.

The present variation produces the same advantageous effects described above.

Embodiment 2

Hereinafter, light fixture 1 according to the present embodiment will be described.

[Configuration]

Figure 9:
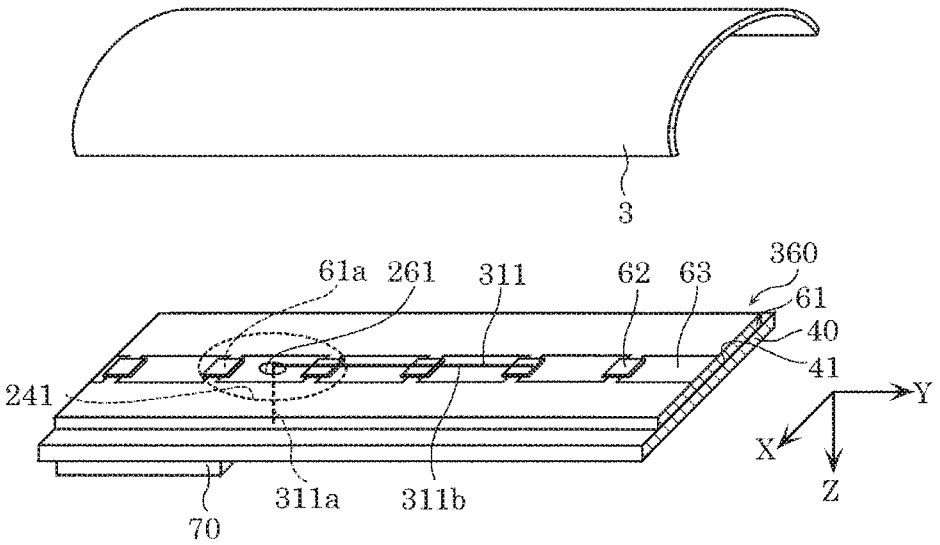
FIG. 9 is a partially enlarged perspective view of a cover, a light-emitting module, a wireless module, etc. of a light fixture according to Embodiment 2.
Figure 10:
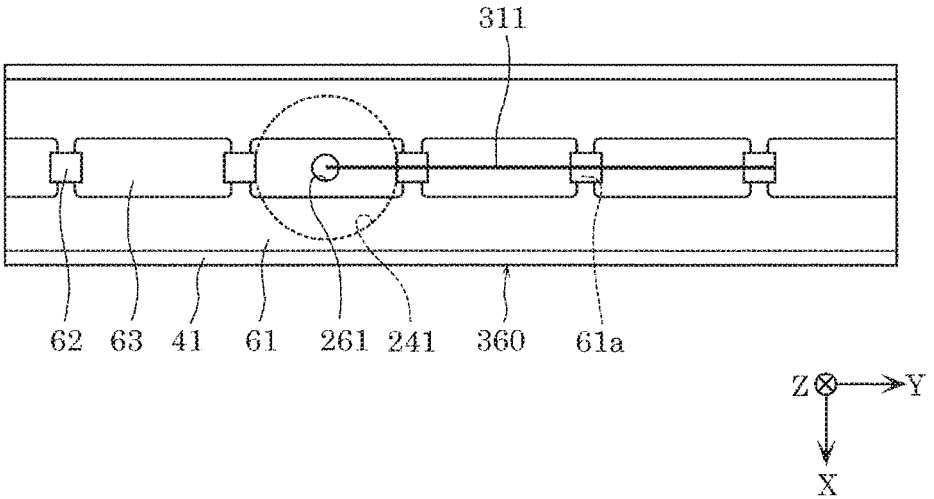
FIG. 10 is a plan view of the light-emitting module and an antenna of the light fixture according to Embodiment 2.

FIG. 9 is a partially enlarged perspective view of cover 3, light-emitting module 360, wireless module 110, etc. of light fixture 1 according to Embodiment 2. FIG. 10 is a plan view of light-emitting module 360 and antenna 311 of light fixture 1 according to Embodiment 2.

Unless otherwise stated, light fixture 1 according to the present embodiment has the same configuration as Embodiment 1. Accordingly, the same structural components are assigned the same reference signs, and detailed description thereof is omitted.

As shown in FIG. 9 and FIG. 10, first insertion hole 261 and second insertion hole 241 in the present embodiment have a circular shape in a plan view.

Antenna 311 is inserted through first insertion hole 261 and second insertion hole 241, bends in a portion between circuit board 61 and cover 3, and extends along the line of light-emitting elements 62. A bending portion of antenna 311 is located in the space between circuit board 61 and cover 3. Specifically, antenna 311 is inserted through first insertion hole 261 and second insertion hole 241, bends in the Y-axis direction, is placed above at least one light-emitting element 622, and extends along the line of light-emitting elements 62. After antenna 311 is inserted through first insertion hole 261 and second insertion hole 241, antenna 311 bends and extends in the Y-axis direction. Antenna 311 has first portion 311*a* that is a portion from wireless controller 112 to a portion bending in the Y-axis direction, and second portion 311*b* that is a portion bending and extending along the surfaces of light-emitting elements 62. Second portion 311*b* extends above light-emitting elements 62.

[Advantageous Effects]

As described above, light fixture 1 according to the present embodiment further includes cover 3 that is light transmissive and covers light-emitting elements 62 and circuit board 61. Light-emitting elements 62 are arranged linearly on circuit board 61. Antenna 311 extends through first insertion hole 261 and second insertion hole 241, includes a bend in a space between circuit board 61 and cover 3, and extends along light-emitting elements 62 arranged linearly.

Antenna 311 has a length that varies with a frequency used for wireless communication with an external device. For this reason, by bending antenna 311 in the space between elongated circuit board 61 and cover 3 along the line of light-emitting elements 62 mounted on circuit board 61, it is possible to ensure a necessary antenna length corresponding to a specified frequency. In particular, by bending antenna 311, it is possible to reduce visual identification of antenna 311 allowed by a shadow created in light fixture 1 by antenna 311.

Moreover, in light fixture 1 according to the present embodiment, antenna 311 is above light-emitting elements 62.

With this configuration, because antenna 311 is above light-emitting elements 62, it is possible to reduce a shadow made by antenna 311 more greatly than a state in which antenna 311 is away from light-emitting elements 62. In particular, it is desirable that antenna 311 be placed on the top surfaces of light-emitting elements 62, and antenna 311 be placed in proximity to the top surfaces of light-emitting elements 62.

The present embodiment produces the same advantageous effects described above.

Embodiment 3

Hereinafter, light fixture 1 according to the present embodiment will be described.

[Configuration]

Figure 11:
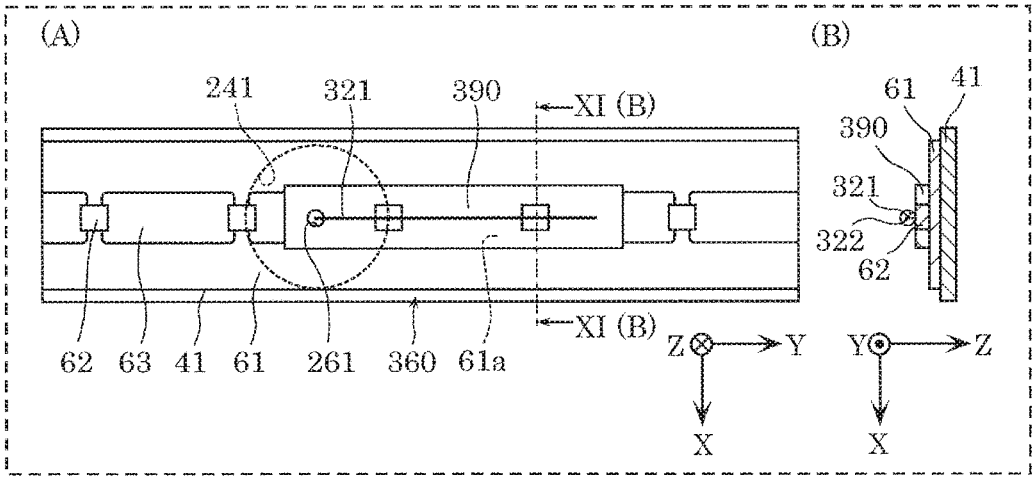
FIG. 11 is a diagram illustrating a light-emitting module and an antenna of a light fixture according to Embodiment 3.

FIG. 11 is a diagram illustrating light-emitting module 360 and antenna 321 of light fixture 1 according to Embodiment 3. (A) in FIG. 11 is a plan view of light-emitting module 360 and antenna 321. (B) FIG. 11 is a cross-sectional view of light-emitting module 360 and antenna 321, taken along the XI(B)-XI(B) line.

Unless otherwise stated, light fixture 1 according to the present embodiment has the same configuration as Embodiment 1. Accordingly, the same structural components are assigned the same reference signs, and detailed description thereof is omitted.

Unless otherwise stated, light fixture 1 according to the present embodiment has the same configuration as Embodiment 2. Accordingly, the same structural components are assigned the same reference signs, and detailed description thereof is omitted.

As shown in FIG. 11, light-emitting module 360 further includes insulation sheet 390 that is light transmissive and placed around light-emitting elements 62.

Insulation sheet 390 surrounds light-emitting elements 62. Specifically, insulation sheet 390 has an elongated plate shape, and is a frame-shaped body that is hollowed at positions corresponding to light-emitting elements 62 when insulation sheet 390 is placed on circuit board 61. In the present embodiment, insulation sheet 390 surrounds adjacent light-emitting elements 62 among light-emitting elements 62. Insulation sheet 390 is fitted to light-emitting module 360. It should be noted that insulation sheet 390 may cover the top surfaces of light-emitting elements 62. Insulation sheet 390 is, for example, a light-transmissive resin material or glass.

At least one of mounting surface 61*a* and antenna 321 is painted white. Mounting surface 61*a* is not limited to a surface on which light-emitting elements 62 are actually mounted, and is a surface of circuit board 61 on the negative side of the Z-axis direction. Moreover, entire mounting surface 61*a* may be painted white, and only a portion of circuit board 61 on which insulation sheet 390 is placed may be painted white. The surface of antenna 321 may be painted white with material 322. Antenna 321 is placed above insulation sheet 390. A portion of antenna 321 may be placed above insulation sheet 390, and another portion of antenna 321 may be placed above light-emitting elements 62.

It should be noted that although antenna 321 may be coated with white resin material 322, antenna 321 may he wound with a white resin film or sheet. Material 322 may be coated with a metal vapor-deposited film made of a metal material, such as silver and aluminum.

Figure 12:
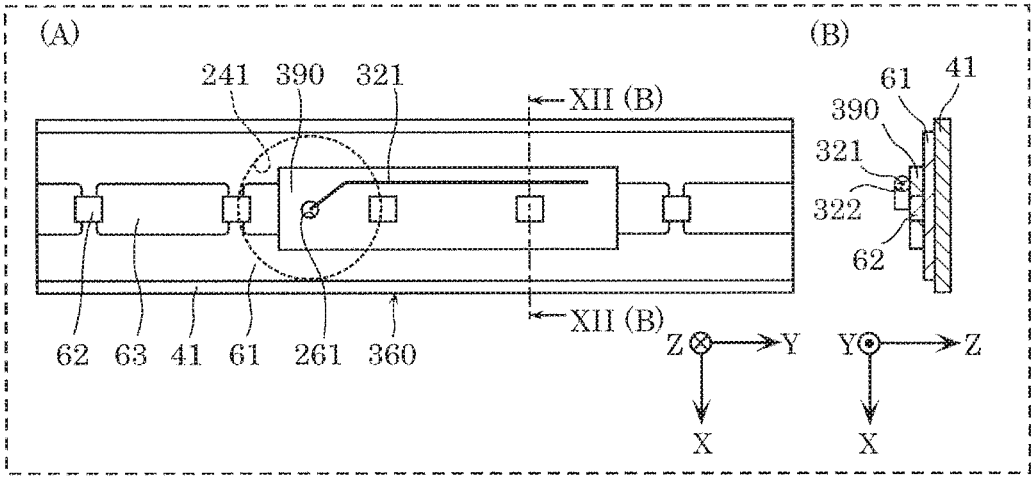
FIG. 12 is a diagram illustrating the light-emitting module and the antenna of the light fixture according to Embodiment 3.

For this reason, for example, the configuration shown in FIG. 12 will do. FIG. 12 is a diagram illustrating light-emitting module 360 and antenna 321 of light fixture 1 according to Embodiment 3. (A) in FIG. 12 is a plan view of light-emitting module 360 and antenna 321. (B) in FIG. 12 is a cross-sectional view of light-emitting module 360 and antenna 321, taken along the XII(B)-XII(B) line. Antenna 321 may bend obliquely relative to the Z-axis direction and further bend approximately parallel to the Z-axis direction. To put it differently, after antenna 321 comes out from first insertion hole 261, antenna 321 bypasses light-emitting elements 62 and extends along the line of light-emitting elements 62, that is, the Y-axis direction.

Figure 13:
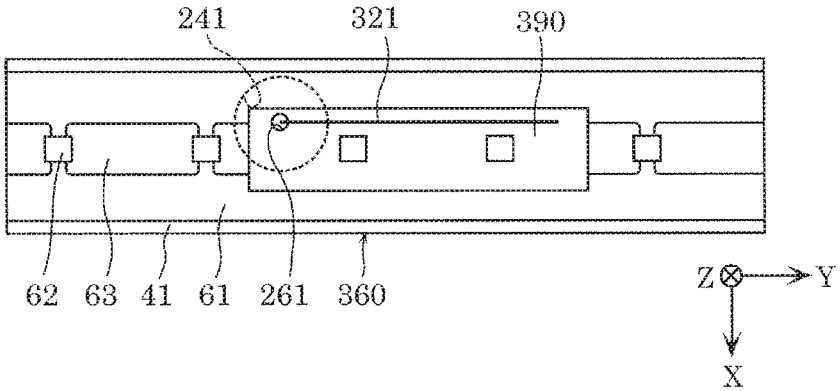
FIG. 13 is a plan view of the light-emitting module and the antenna of the light fixture according to Embodiment 3.

Moreover, for example, the configuration shown in FIG. 13 will do. FIG. 13 is a plan view of light--emitting module 360 and antenna 321 of light fixture 1 according to Embodiment 3. The center line of first insertion hole 261 and second insertion hole 241 deviates from two adjacent light-emitting elements 62 in the X-axis direction (in the present embodiment, toward the negative side of the X-axis direction). After antenna 321 comes out from first insertion hole 261, antenna 321 extends along the line of light-emitting elements 62.

[Advantageous Effects]

As described above, light fixture 1 according to the present embodiment further includes insulation sheet 390 that is light transmissive and is positioned around antenna 321 and light-emitting elements 62. At least one of mounting surface 61*a* and antenna 321 is white. Antenna 321 is above insulation sheet 390.

With this configuration, because white antenna 321 is above light-transmissive insulation sheet 390, white antenna 321 reflects light emitted from light-emitting elements 62. Accordingly, it is possible to reduce a decrease in amount of light caused by antenna 321.

The present embodiment produces the same advantageous effects described above.

Other Variations

Although the light fixture according to the present disclosure has been described on the basis of aforementioned Embodiments 1 to 3 and the variation of Embodiment 1, the present disclosure is not limited to aforementioned Embodiments 1 to 3 and the variation of Embodiment 1.

Figure 14:
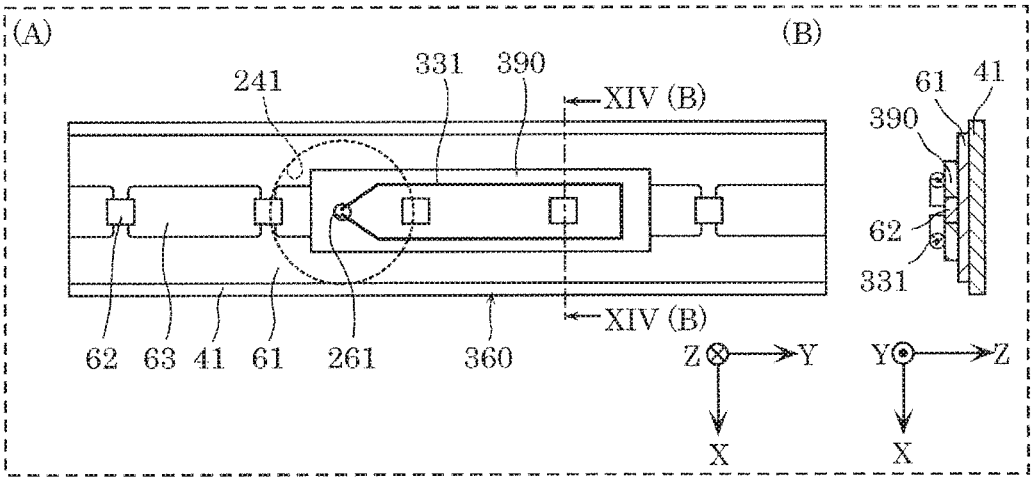
FIG. 14 is a diagram illustrating a light-emitting module and an antenna of a light fixture according to a variation.

For example, antenna 312 included in light fixture 1 according to aforementioned Embodiments 1 to 3 and the variation of Embodiment 1 may be the antenna shown in FIG. 14. FIG. 14 is a diagram illustrating light-emitting module 360 and antenna 331 of light fixture 1 according to a variation. (A) in FIG. 14 is a plan view of light-emitting module 360 and antenna 331. (B) in FIG. 14 is a cross-sectional view of light-emitting module 360 and antenna 331, taken along the XIV(B)-XIV(B) line. Antenna 331 shown in FIG. 14 surrounds least one of light-emitting elements 62. Antenna 331 is above insulation sheet 390. It should be noted that insulation sheet 390 need not be provided. In such light fixture 1, antenna 331 surrounds at least one of light-emitting elements 62. According to this configuration, antenna 331 surrounds at least one of light-emitting elements 62, and thus light emitted by the at least one of light-emitting elements 62 is not easily blocked.

Figure 15:
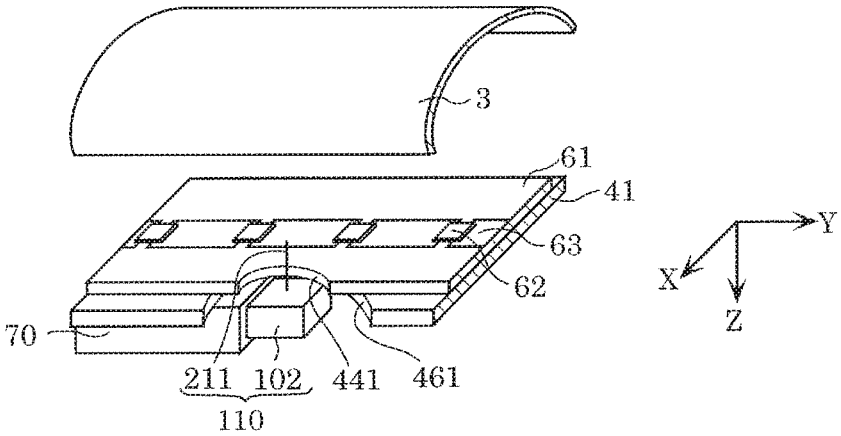
FIG. 15 is a partially enlarged perspective view of a cover, the light-emitting module, a wireless module, etc. of the light fixture according to the variation.
Figure 16:
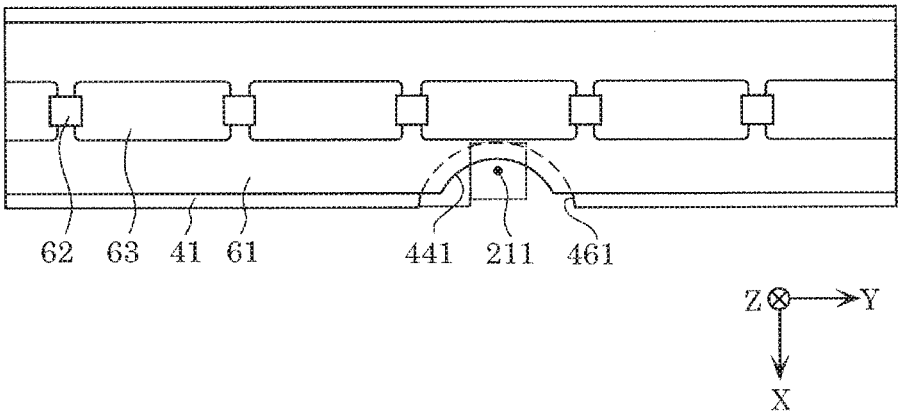
FIG. 16 is a diagram illustrating the light-emitting module and the antenna of the light fixture according to the variation.

Moreover, in light fixture 1 according to aforementioned Embodiments 1 to 3 and the variation of Embodiment 1, the first insertion portion may be first cutout 461 shown in FIG. 15 and FIG. 16, and the second insertion portion may be second cutout 441 shown in FIG. 15 and FIG. 16. For this reason, the first insertion portion and the second insertion portion are not limited to the first insertion hole and the second insertion hole, respectively. Circuit board 61 and base 40 have first cutout 461 and second cutout 441, respectively. The area of first cutout 461 is smaller than the area of second cutout 441 in a plan view of circuit board 61 and base 40. In FIG. 16, antenna 211 is, for example, a monopole antenna. Antenna 211 is placed in proximity to first cutout 461.

Moreover, in the light fixture according to aforementioned Embodiments 2 and 3, the antenna extends along the line of the light-emitting elements, that is, the Y-axis direction. However, the antenna may extend in the X-axis direction, and a direction in which the antenna extends is not particularly limited.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A light fixture, comprising:

a board including a first insertion portion;

a plurality of light-emitting elements mounted on a mounting surface of the board;

a metal case on which the board is positioned; and an antenna that is housed in the metal case and wirelessly communicates with an external device, wherein the metal case includes a second insertion portion at a position overlapping with the first insertion portion in a plan view of the metal case and the board, and the antenna extends through the first insertion portion and the second insertion portion.

2. The light fixture according to claim 1, further comprising:

a cover that is light transmissive and covers the plurality of light-emitting elements and the board, wherein the plurality of light-emitting elements are arranged linearly on the board, and the antenna extends through the first insertion portion and the second insertion portion, includes a bend in a space between the board and the cover, and extends along the plurality of light-emitting elements arranged linearly.

3. The light fixture according to claim 2, wherein the antenna surrounds at least one of the plurality of light-emitting elements.

4. The light fixture according to claim 2, wherein the antenna is above the plurality of light-emitting elements.

5. The light fixture according to claim 1, further comprising:

an insulation sheet that is light transmissive and is positioned around the antenna and the plurality of light-emitting elements, wherein the antenna is above the insulation sheet.

6. The light fixture according to claim 1, wherein at least one of the mounting surface and the antenna is white.

7. The light fixture according to claim 1, wherein the antenna has a portion extending approximately vertically relative to the mounting surface.

8. The light fixture according to claim 1, further comprising:

a cover that is light transmissive and covers the plurality of light-emitting elements and the board, wherein the antenna has a portion protruding from the mounting surface toward the cover.

9. The light fixture according to claim 1, wherein the board is elongated, and the first insertion portion extends crosswise to a direction of elongation of the board, at a position approximately midway between two adjacent light-emitting elements of the plurality of light-emitting elements.

10. The light fixture according to claim 1, wherein the second insertion portion overlaps with the first insertion portion in a plan view of the first insertion portion and the second insertion portion, and an area of the first insertion portion is smaller than an area of the second insertion portion in the plan view of the first insertion portion and the second insertion portion.

11. The light fixture according to claim 1, further comprising;

a wireless module including the antenna; and a power supply connected to the wireless module.

12. The light fixture according to claim 2, wherein the cover has a light-diffusing property.

13. A light fixture, comprising:

a board including a first insertion portion;

a plurality of light-emitting elements mounted on a mounting surface of the board;

a metal case that houses the board; and an antenna that is housed in the metal case and wirelessly communicates with an external device, wherein the metal case includes a second insertion portion at a position overlapping with the first insertion portion in a plan view of the metal case and the board, and the antenna extends through the first insertion portion and the second insertion portion, and is exposed from the metal case and the board.

* * * * *